United States Patent [19]

Farmer, Jr.

[11] Patent Number: 4,469,170

[45] Date of Patent: Sep. 4, 1984

[54] LIQUID SKIMMER APPARATUS

[75] Inventor: Verne E. Farmer, Jr., Houston, Tex.

[73] Assignee: Exxon Research and Engineering Co., Florham Park, N.J.

[21] Appl. No.: 353,795

[22] Filed: Mar. 2, 1982

[51] Int. Cl.[3] ..... E21B 43/38; E02B 15/04

[52] U.S. Cl. ..... 166/53; 166/65 R; 166/107; 166/369; 166/265; 210/104; 210/109; 210/242.3; 210/923

[58] Field of Search ..... 210/96.1, 104, 109, 210/114, 115, 121, 744, 538, 800, 242.3, 923, 97, 98, 86; 73/304 R; 166/265, 53, 65 R, 107, 369

[56] References Cited

U.S. PATENT DOCUMENTS

| | | | |
|---|---|---|---|
| 1,094,861 | 4/1914 | Murphy | 210/114 |
| 1,107,391 | 8/1914 | Welch | 210/242.3 |
| 2,625,039 | 1/1953 | Wagner | 73/304 R |
| 2,632,324 | 3/1953 | Oberlin | 73/304 R |
| 3,534,599 | 10/1970 | Hoehne | 73/304 R |
| 3,755,804 | 8/1973 | Johnson | 210/104 |
| 3,782,553 | 1/1974 | Brekke | 210/242.3 |
| 3,794,175 | 1/1974 | Stewart | 210/242.3 |
| 3,901,811 | 8/1975 | Finch | 210/538 |
| 4,032,444 | 6/1977 | Wright et al. | 210/104 |
| 4,273,650 | 6/1981 | Solomon | 210/109 |

FOREIGN PATENT DOCUMENTS

| | | | |
|---|---|---|---|
| 2928701 | 2/1981 | Fed. Rep. of Germany | 210/104 |
| 0049527 | 12/1980 | Japan | 210/121 |
| 0605110 | 4/1978 | U.S.S.R. | 73/304 R |

*Primary Examiner*—Ernest G. Therkorn
*Assistant Examiner*—John W. Czaja
*Attorney, Agent, or Firm*—John S. Schneider

[57] ABSTRACT

Apparatus for skimming an overlying non-conductive lighter liquid from an underlying conductive heavier liquid in a two-liquid body which are particularly applicable for recovering oil and/or gasoline from a well. A skimmer designed to float in the two-liquid body contained in the well includes a closed cylindrical float, a hollow cylindrical skirt installed over a portion of one end of the float and permanently attached to the float. The end of the skirt surrounding the float is open to the lighter liquid. Spaced-apart liquid level controls are positioned on the skirt for sensing the liquid/liquid interface level. The other end of the skirt is connected to a pump for removing lighter liquids collected in the skirt. Means operated by the controls turn the pump off and on in response to higher and lower levels, respectively, of the two-liquid interface.

10 Claims, 4 Drawing Figures

LIQUID SKIMMER APPARATUS

BACKGROUND OF THE INVENTION

Among the tens of thousands of sites where oil and oil products are handled, such as service stations, terminals, refineries, pipelines etc., there inevitably are accidental spills and leaks where substantial quantities of liquid hydrocarbons are lost into the subsurface. In most cases this liquid descends through the soil and finally accumulates on the water table from which it must be removed.

Equipment and methods used in handling surface spills are generally of no use in subsurface situations because of the relatively small diameter of recovery wells.

The most common method of underground recovery is to drill a well, typically thirty feet or more below the water table. By pumping water from the bottom of this well, a cone-shaped depression is created on the water table with the well as the apex. The lighter floating hydrocarbon liquid then collects in the well where it is removed by a second pump located at a fixed position near the liquid surface in the well. Systems such as this are illustrated in U.S. Pat. No. 3,901,811 issued to Finch and in U.S. Pat. No. 4,273,650 issued to Solomon. To avoid creating other problems it is necessary that these systems produce water-free product. The systems are effective as long as the pump intake and the fluid interfaces, hydrocarbon/water and hydrocarbon/air, are in the proper relationship to each other. They will, however, tolerate little variation in this relationship and still remain effective. Under natural conditions a water table is seldom static. It is usually rising or falling at varying rates depending mostly on the amount of recharge water being received from precipitation. As the water table changes, so does the pumping level in a well. Each change lowers the efficiency of a fixed-position pump and necessitates frequent observation and readjustment, thus making the process a very labor-intensive operation.

The problems associated with a fixed-position well skimmer can be eliminated by using a floating skimmer which will adjust to natural changes of the water table level. Due to the different specific gravities of hydrocarbons and water any object will float higher in water than it will in hydrocarbons. This invention utilizes this principle and allows, thereby, the floating skimmer to function indefinitely without attention.

SUMMARY OF THE INVENTION

Skimmer apparatus for removing an overlying hydrocarbon liquid, such as oil, from underlying water in a well includes a closed float adapted to float in such two-liquid body; a skirt receptacle connected to said float, one end of said receptacle having openings for collecting said hydrocarbon liquid in said receptacle; spaced-apart sensors attached to said receptacle to sense the hydrocarbon-water interface and means for removing the hydrocarbon liquid from the receptacle in response to the level of said hydrocarbon-water interface.

DESCRIPTION OF THE PREFERRED EMBODIMENT

Figure 1:
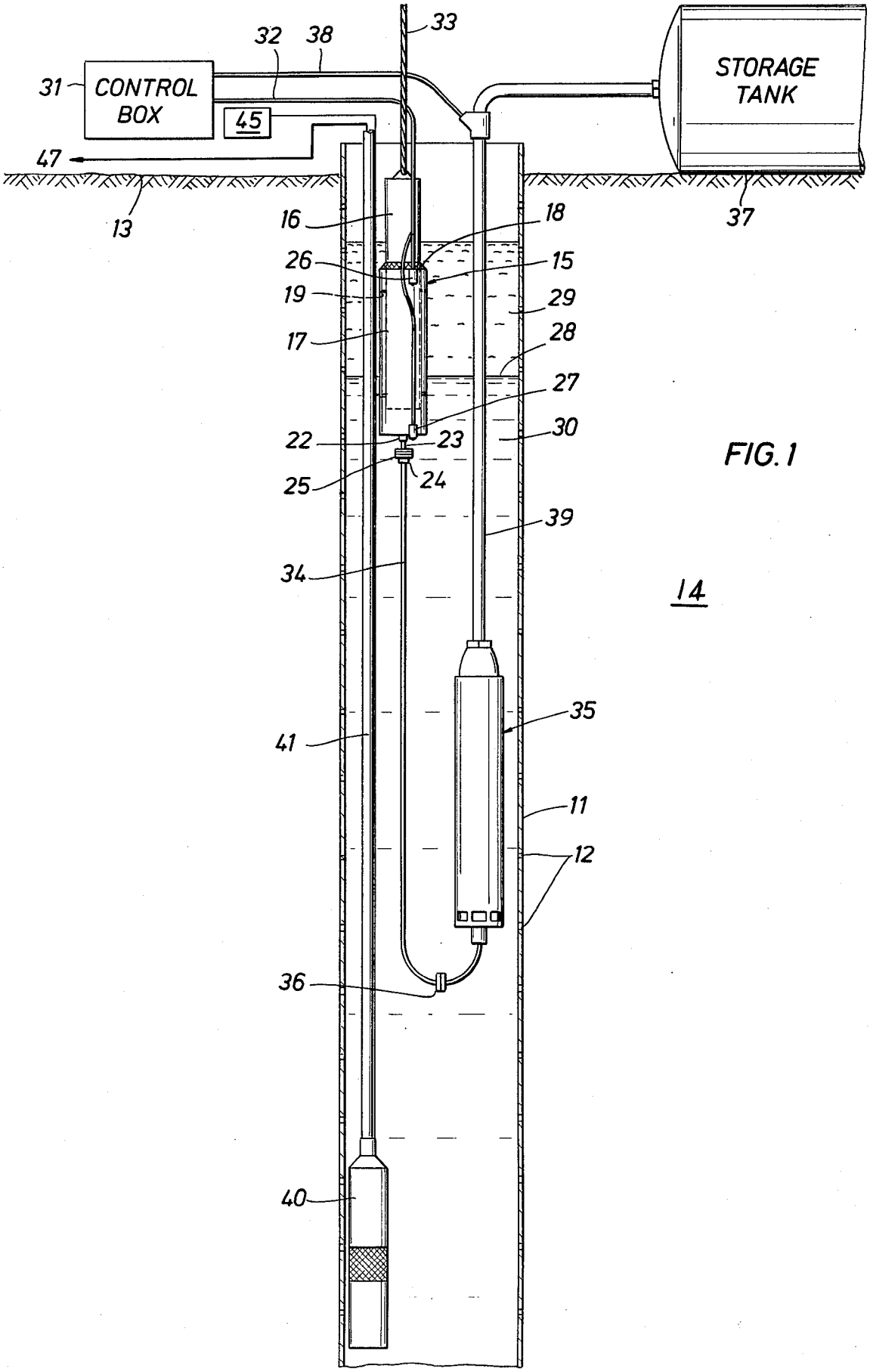
FIG. 1 is a diagramatic side elevation in section illustrating the skimmer system of the invention.

A well pipe 11, containing perforations 12, is shown in FIG. 1 extending from the earth's surface 13 into an aquifer 14 at or near the location of an oil spill. Oil and water enter casing 11 through perforations 12 forming a layer of oil 29 overlying a body of water 30 with the interface therebetween indicated 28. A skimmer 15 is shown floating in the oil and water. The skimmer includes a sealed, light weight, cylindrical float 16 and a hollow cylindrical skirt receptacle 17 having an upper screened open end 18 installed over the lower portion of float 16 and permanently attached to the float by structural members 19. In this embodiment float 16 is twenty-six inches long and has a diameter of four inches and skirt 17 is fifteen inches long and has a diameter of six inches. A pipe fitting 22 is installed on the closed bottom end of skirt 17. A tail pipe 23 is connected to fitting 22 and serves as an exit conduit for the oil collected by the receptacle. At the bottom of tail pipe 23 is a holder 24 to which small weights 25 may be added or removed. The weights allow adjustment of the total weight of skimmer 15 to that required for most efficient operation. In addition, it lowers the center of gravity of the skimmer and ensures a vertical float position for the float and skimmer skirt.

Fluid level control sensors 26 and 27 are attached to the top and bottom, respectively, of skimmer skirt 17. These controls sense interface 28 between the non-conductive oil 29 and the conductive water 30. Each sensor 26 and 27 may suitably be an electrode which opens and closes an electric circuit in response to the oil-water interface. A control box 31 contains, among other components, sensing relays, not shown, responsive to the opening and closing of the electric circuit which controls transmission of power through cable 38 to operate pump 35.

A handling line 33 attached to the upper end of float 16 is solely for use in installing or removing skimmer 15 from well 11. During operation of the skimmer, handling line 33 is slack. A flexible hose 34 connects the bottom of tail pipe 23 to the intake of an electrically operated pump 35. Additional weights 36 may be attached to hose 34 to neutralize bouyancy of and maintain hose 34 in proper position. The discharge end of pump 35 is connected to a hose 39 which, in turn, is connected to a surface storage tank 37.

A power cable 38 connected to a surface power source extends internally through hose 39 to pump 35 for operating pump 35. An electrically operated water-depression pump 40 powered and controlled from a control box 45, as indicated, is positioned in the water 30 portion of pipe 11. Pump 40 is connected to a water pump riser 41 which extends to a waste reservoir on the earth's surface indicated by the arrowed line and numeral 47.

Figure 4:
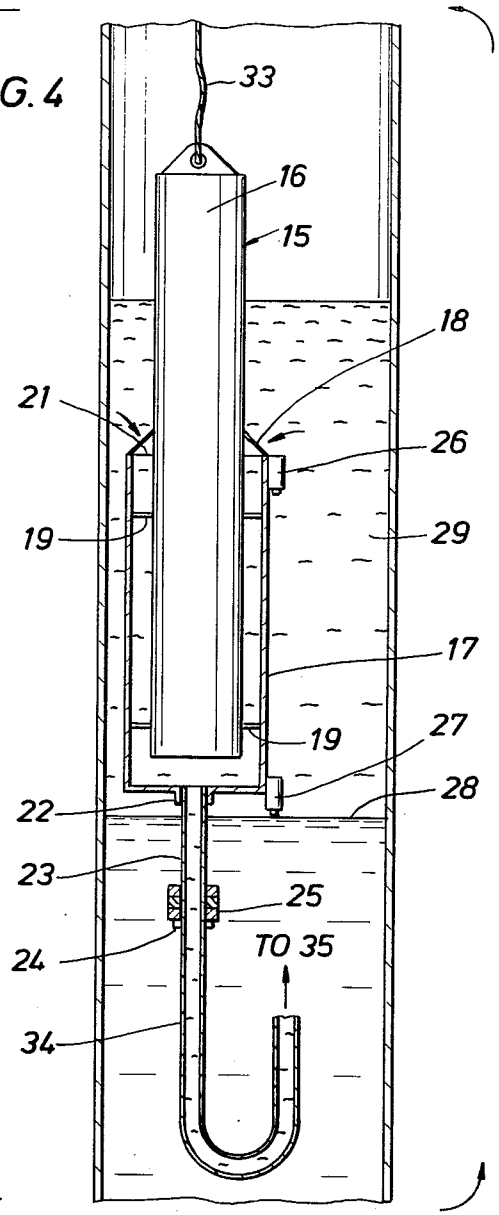
FIGS. 2 through 4 are diagramatic side elevation views in section illustrating operation of that skimmer system.
Figure 3:
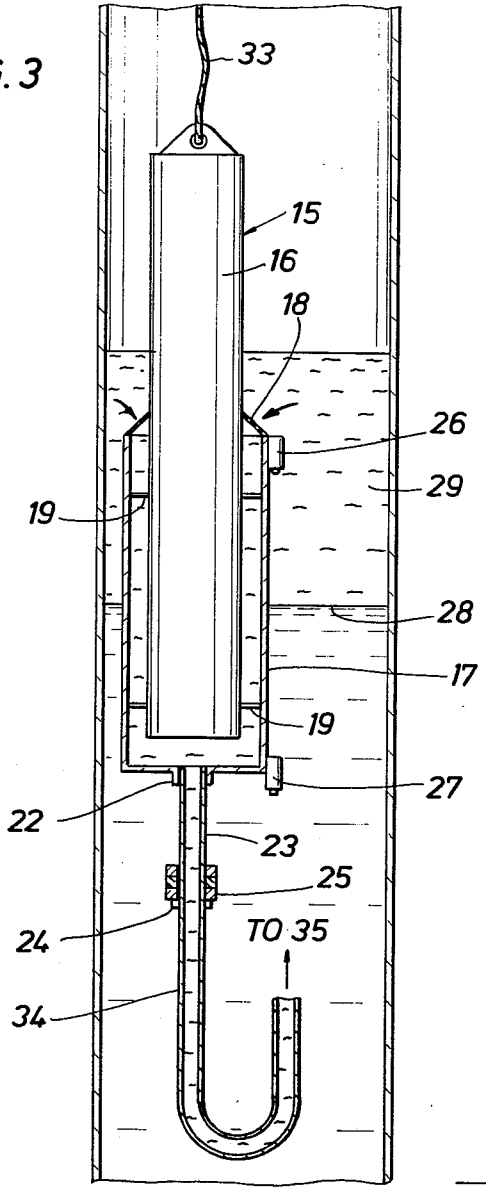
Figure 2:
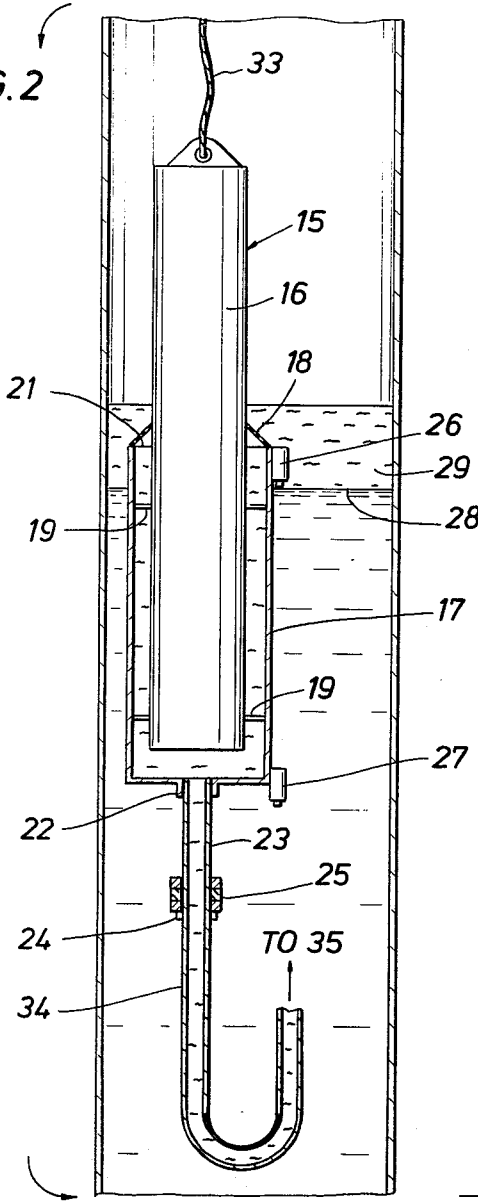

Reference is now made to FIGS. 2 through 4 for a description of the operation of the skimmer in removing oil from the water table. The arrowed lines adjacent these Figures indicate the sequence of steps in the oil pump-down cycle.

Skimmer 15 is shown installed in a twelve inch diameter perforated well pipe 11.

FIG. 2 illustrates the configuration at the beginning of the "refill cycle". Pump 35 is deactivated by oil contact with upper probe 26, the "off" probe. Approximately three inches of oil 29 floats on water surface 28. The internal flow system, that is, skirt 17 and hose 34, is full of oil. In this state skimmer 15 would have just completed a pumping cycle and pump 35 automatically turned off when the oil/water interface contacted upper sensor 26. The level at which skimmer 13 will float in this combination of fluids is illustrated. This precise position is achieved by adjusting the amount of weight 25 on tail pipe 23.

From the FIG. 2 condition the following chronological series of events will occur. It is understood that oil is constantly entering pipe 11 through perforations 12 so the thickness of oil layer 29 is constantly and steadily increasing. In FIG. 2 skimmer 15 is floating almost entirely in water 30 and pump 35 is not running. As oil continually enters well pipe 11, the oil layer 29 thickens and the oil/water interface 28 moves relatively downward. Skimmer 15 floats ever lower in the increasing oil column 29.

FIG. 3 shows the configuration about midpoint of the "refill" or oil expansion cycle.

In FIG. 4 the oil thickness 29 has increased to where skimmer 15 is floating entirely in oil. This configuration is at the end of the "refill" cycle at the instant before activation of pump 35. Its float position is lower than in FIG. 2 because of the lower specific gravity of oil. The screened top 18 of skirt 17 is covered by several inches of oil 29. The downward moving oil/water interface 28 has reached the "on" sensor 27 and an electrical signal sent to control box 31 through electrical line 32 causes pump 35 to turn on. Oil begins to exit through tail pipe 23 and flexible hose 34 and is replaced by oil entering through the screened top 18 of skirt 17 as shown by the arrows.

FIG. 4 also shows the configuration at the beginning of the "pump down" cycle. Pump 35 is activated by the oil contact with the "on" probe 27. As oil is removed from pipe 11, the oil column 29 becomes thinner and the oil/water interface 28 will steadily rise. FIG. 3 now shows the decreasing oil column at midpoint of the "pump down" cycle. When the interface finally reaches the "off" sensor 26, pump 35 will turn off. The configuration in FIG. 1 illustrates the end of the "pump down" cycle at the instant before deactivation of pump 35. The cycle will automatically begin again.

Changes and modifications may be made in the specific embodiments of the invention shown and described herein without departing from the scope of the invention as defined in the appended claims. Thus, while the preferred embodiment of the invention has been described with respect to its preferred use with electrically non-conductive liquids, such as oil or oil products, and electrically conductive liquids, such as water, the invention is also applicable to liquids having similar conductivities. In such cases the control sensors may be of a magnetic type which moves with the liquid level between the immissible liquids of different specific gravities to actuate switches to open or close the electric circuit. Further, float 16 and receptacle skirt 17 and other components of the skimmer system while preferably made of metal may be made of nonmetallic materials. The dimensions of the well pipe and of the components set forth in the description of the preferred embodiment are for purposes of illustration only. Also, the float and skirt may have configurations that are other than cylindrical.

What is claimed is:

1. Skimmer apparatus for removing an overlying lighter liquid from an underlying heavier liquid in a well comprising:

a float adapted to float in said two liquids;

a receptacle connected to said float, one end of said receptacle being open for collecting said lighter liquid in said receptacle;

spaced-apart sensors attached to said receptacle for sensing the lighter-heavier liquid interface;

means for removing said ligher liquid from said receptacle in response to the level of said interface in said well;

said lighter liquid comprises an electrical non-conductor and said heavier liquid comprises an electrical conductor; means for adjusting the buoyancy of said skimmer in said liquids; and said float being closed and said receptacle forming a skirt surrounding a portion of said float.

2. Apparatus as recited in claim 1 in which said float and said receptacle are cylindrically configured.

3. Apparatus as recited in claim 1 in which said lighter liquid comprises a hydrocarbon and said heavier liquid comprises water.

4. Apparatus as recited in claim 3 in which said sensors include electrical conductors.

5. Apparatus as recited in claims 3 or 4 in which said removal means includes pump means connected to said receptacle; and electrical circuit means connected to said sensors and to said pump means for actuating and deactivating said pump means in response to the level of said interface in said well.

6. Skimmer apparatus arranged in a well containing lighter and heavier liquids comprising:

a float floating in said liquids;

a receptacle connected to said float, the upper end of said receptacle being open for collecting said lighter liquid in said receptacle;

spaced apart sensors attached to said receptacle for sensing the lighter-heavier liquid interface;

means for removing said lighter liquid from said receptacle in response to the level of said interface in said well;

said ligther liquid comprises an electrical non-conductor and said heavier liquid comprises an electrical conductor; means for adjusting the buoyancy of said skimmer in said liquids; and said receptacle surrounding a portion of said float.

7. Apparatus as recited in claim 6 in which said float and said receptacle are cylindrically configured.

8. Apparatus as recited in claim 6 in which said lighter liquid comprises a hydrocarbon and said heavier liquid comprises water.

9. Apparatus as recited in claim 8 in which said sensors include electrical conductors.

10. Apparatus as recited in claims 8 or 9 in which said removal means includes pump means connected to said receptacle and electrical circuit means connected to said sensors and to said pump means for actuating and deactivating said pump means in response to the level of said interface in said well.

* * * * *